US005564443A

United States Patent [19]

Cardenas

[11] Patent Number: 5,564,443

[45] Date of Patent: Oct. 15, 1996

[54] PORTABLE EXTINGUISHING DEVICE

[76] Inventor: Luis P. Cardenas, 112 Rossland Road W, Unit 25, Whitby, Ontario, L1N 9H3, Canada

[21] Appl. No.: 284,481

[22] PCT Filed: Feb. 4, 1993

[86] PCT No.: PCT/CA93/00028

§ 371 Date: Aug. 5, 1994

§ 102(e) Date: Aug. 5, 1994

[87] PCT Pub. No.: WO93/15620

PCT Pub. Date: Aug. 19, 1993

[30] Foreign Application Priority Data

Feb. 6, 1992 [CA] Canada ..... 206080

[51] Int. Cl.[6] ..... A24H 13/18

[52] U.S. Cl. ..... 131/256; 131/235.1; 131/231; 131/178

[58] Field of Search ..... 131/257, 256, 131/258; 431/151, 152

[56] References Cited

U.S. PATENT DOCUMENTS

| | | | |
|---|---|---|---|
| 2,309,011 | 1/1943 | Porter . | |
| 2,513,151 | 6/1950 | Mesquita | 431/152 |
| 3,291,138 | 12/1966 | Thompson | 131/256 |
| 3,410,322 | 11/1968 | Lockwood | 431/152 |
| 4,473,084 | 9/1984 | Marshall . | |
| 4,478,230 | 10/1984 | Mazelie . | |

FOREIGN PATENT DOCUMENTS

| | | |
|---|---|---|
| 2359377 | 2/1978 | France . |
| 2386992 | 11/1978 | France . |
| 3442106 | 5/1986 | Germany . |

OTHER PUBLICATIONS

Blaisdll et al.–Table Lighter–Dec. 18, 1956, pp. 1–2.

Miller–Cigarette Lighter Assembly–Nov. 7, 1950–pp. 1 and 3.

*Primary Examiner*—Vincent Millin
*Assistant Examiner*—Charles Anderson
*Attorney, Agent, or Firm*—Bereskin & Parr

[57] ABSTRACT

Holder of cigarette lighter with a cup for a cigarette holder that works as a cigarette extinguisher device as well as collects the ashes of a cigarette and at the end extinguishes the cigarette butt. This device or invention can be made of plastic, metal or combinations of any material that is not combustible. The dimensions of the device can vary but is approximately of 32 mm long by 12 mm wide by 35 mm high. The cup is approximately in diameter of 11 mm by 31 mm high with an entrance wide of the top ring to get easy access for the cigarette approximately of 16 mm of diameter ring made with a shape coniferous for the easy access of the cigarette into the cup.

11 Claims, 1 Drawing Sheet

PORTABLE EXTINGUISHING DEVICE

FIELD OF THE INVENTION

The present invention relates to portable accessories for use by smokers of cigarettes, cigars and the like.

BACKGROUND OF THE INVENTION

Smokers of cigarettes, cigars and the like are well aware nowadays of how their smoking disturbs and endangers those around them. Non-smokers especially are disturbed by the health risks associated with inhaling the second-hand smoke given off from the burning tip of a cigarette. Many people are also concerned about the risk of fire caused by a discarded cigarette that has been improperly extinguished or by a burning cigarette that has been lost or left unattended.

It has been found that the repeated extinguishing and lighting of a cigarette between puffs leads to a significant reduction in both second hand smoke and fire hazards. Various devices have been developed for extinguishing a cigarette between puffs and examples are provided below.

One such device is provided by U.S. Pat. No. 2,309,011 issued to Porter. This patent describes a device that may be carried by a smoker and used to periodically extinguish a cigarette. The device may either be used on its own or be integrally connected to a lighter. The primary object of this device is to extinguish the cigarette in such a way that its flavour will not be impaired when it is lighted again. One problem with the device is that it does not facilitate the removable attachment of lighters to the extinguisher unit. This is important since it is sometimes desirable to use the lighter separately from the extinguisher. Also, many lighters nowadays are disposable and it is desirable that the lighter can be replaced once it has expired.

Another device is provided in U.S. Pat. No. 4,473,084 issued to Marshall. This patent describes an ashtray having a receiver that is adapted to support and extinguish a cigarette. The ashtray includes a storage space of predetermined shape for receiving a lighter. The ashtray may not be conveniently carried however and is not adapted to grip onto lighters of different shapes or sizes.

What is needed is a portable extinguishing device that overcomes the above problems and that permits a smoker to conveniently extinguish and relight his cigarette between puffs.

SUMMARY OF THE INVENTION

In one aspect, the present invention provides a portable extinguishing device comprising:

means for extinguishing a cylindrical smoking material; and a casing for carrying said extinguishing means; characterized in that said casing includes a pair of opposing jaws that are resiliently biased toward each other for releasably gripping a lighter.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF THE PREFERRED EMBODIMENT

Figure 1:
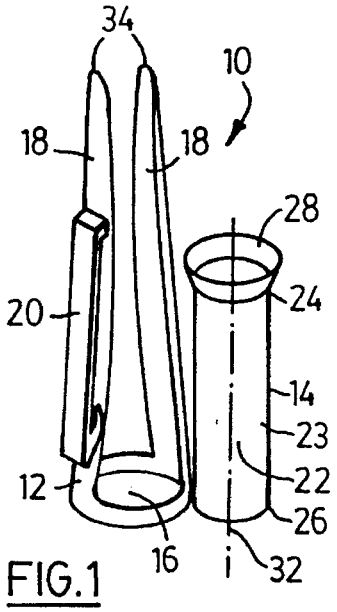
FIG. 1 is a disassembled, perspective view of an extinguishing device in accordance with the present invention, with a first embodiment of a casing positioned beside an extinguishing cup.
Figure 5:
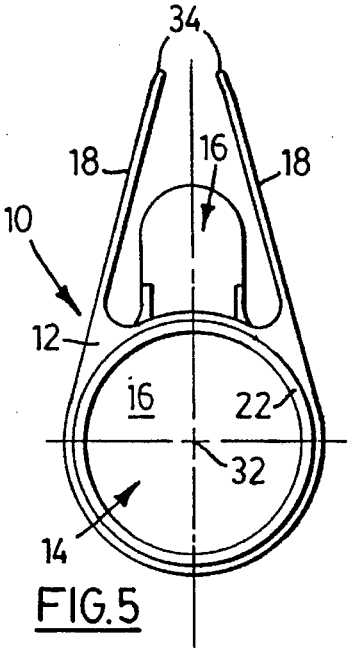
FIG. 5 is a top view of the casing of FIG. 4, in combination with an extinguishing cup.

A portable extinguishing device in accordance with the present invention is shown generally at 10 in FIGS. 1 and 5. The device is described below for use with conventional cigarettes however it should be understood that the apparatus may be modified for use with cigars or other cylindrical smoking materials.

The device 10 includes a casing 12 that is adapted to carry an extinguishing cup 14 and a lighter (not shown). In FIG. 1, the device is shown disassembled with a first embodiment of the casing 12 positioned beside the extinguishing cup 14. Several alternative embodiments of the casing 12 are shown in FIGS. 2–5 and are described further below. For convenience, the same reference numerals are used to refer to similar elements of the different casing embodiments.

Referring to FIG. 1, the casing 12 includes a circular, planar base 16 and a pair of opposing jaws 18. The base 16 has a flat bottom for standing the device 10 on a level surface as shown in FIG. 1. The jaws 18 are resiliently biased toward each other and are adapted to releasably grip the lighter. The jaws 18 are integrally and resiliently connected to the base 16 and terminate at tips 34. A clip 20 is connected to the outer surface of one jaw 18 to facilitate attachment of the device 10 to a smoker's shirt pocket, belt or the like.

The extinguishing cup 14 is adapted both for extinguishing a cigarette and for supporting the extinguished cigarette until the smoker wishes to relight it. In addition, the cup 14 provides a receptacle for collecting ashes from the cigarette. The cup 14 includes a generally cylindrical chamber 22 having first and second ends 24 and 26. The length of the chamber 22 is selected so that its wall 23 supports the cigarette and discourages it from falling from the cup 14. When used for most commercially available cigarettes, the chamber 22 preferably has a length of approximately 31 mm and a diameter of approximately 11 mm.

The first end 24 of the cup 14 is open and is adapted to receive the burning end of a cigarette. A frusto-conical flange 28 extends about the perimeter of the first end 24 to guide the cigarette into the chamber 22. In the preferred embodiment the flange 28 has a maximum diameter of approximately 16 mm.

The second end 26 of the cup 14 is also open in the preferred embodiment and is adapted to sit against the base 16 of the casing. The second end 26 is eventually closed by the base 16 of the casing 12 when the casing 12 and cup 14 are combined. The cigarette becomes extinguished in known manner when it is inserted into the chamber 22 and contacts the closed second end 26 of the cup 14. The base 16 is therefore made from a nonflammable material so that it will not catch fire or melt when contacted by the burning end of the cigarette.

Figure 2:
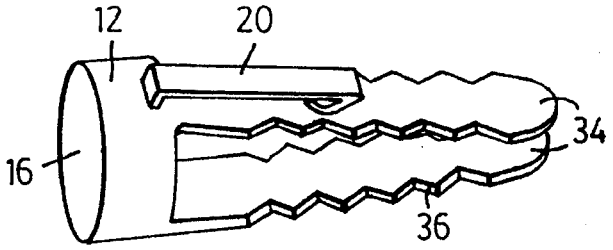
FIG. 2 is a perspective view of a second embodiment of the casing shown in FIG. 1.
Figure 3:
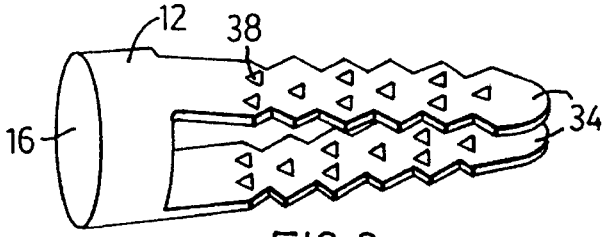
FIG. 3 is a perspective view of a third embodiment of the casing shown in FIG. 1.

First, second and third embodiments of the casing 12 are depicted respectively in FIGS. 1–3. All three embodiments feature a generally cylindrical casing 12 with a similar arrangement of jaws 18. In each case, the jaws 18 extend vertically from the base 16 on opposing sides of the cylindrical chamber 22 so that they are generally parallel to its centre axis 32. As shown, the jaws 18 slope inwardly toward each other from the base 16 to the tips 34. The cup 14 is adapted to fit between the jaws 16 with the second end 26 of the cup 14 sitting upon the base 16. The cup is releasably held in place by the resiliently biased jaws 18. The jaws 18 are longer than the cup 14 in order that they may also releasably grip a lighter. The lighter is held between the flange 28 of the cup 14 and the tips 34 of the jaws 16.

Referring to FIG. 2, the second embodiment of the casing 12 includes serrations 36 on the edges of the jaws 16. Referring to FIG. 3, the third embodiment of casing 12 further includes teeth 38 protruding inwardly from the inner surface of each jaw 16.

Figure 4:
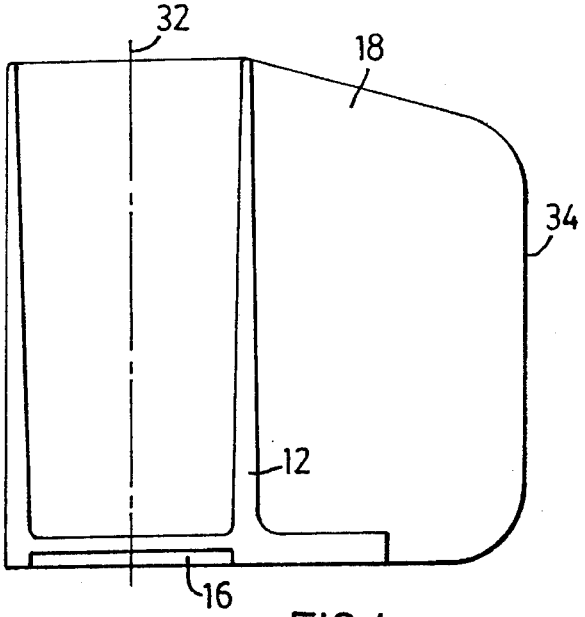
FIG. 4 is a side view of a fourth embodiment of the casing shown in FIG. 1.

A fourth embodiment of the casing 12 is shown in FIGS. 4 and 5. This embodiment features a casing 12 with a different arrangement of jaws from the first three embodiments. Again, the base 16 of the casing 12 has a flat bottom for standing the device 10 on a level surface as shown in FIG. 4. In this embodiment, the jaws 16 extend horizontally from opposing sides of the chamber 22 so that they are generally normal to its axis 32. The jaws 18 slope inwardly toward each other from the base 16 to the tips 34. This arrangement of jaws 16 enables a lighter to be releasably attached to one side of the cup 14. Preferably, the fourth embodiment of casing 12 has a length of approximately 32 mm, a width of approximately 12 mm, and a height of approximately 35 mm.

In use, a smoker would deposit a burning cigarette into the extinguishing cup 14 between puffs. The cigarette would become extinguished and will rest in the cup 14 until accessed once again by the smoker. The flat base 16 permits the device 10 to be rested on any convenient level surface. Also, the clip 20 as shown in FIGS. 1 and 2 may be used to attach the device 10 to a person's shirt pocket or belt. Alternatively, the device 10 is small enough to fit in a person's pocket.

When the smoker wishes to take another puff of the cigarette, he withdraws the extinguished cigarette from the cup 14 and relights it with the lighter. As a result, the amount of second hand smoke emanating from the cigarette between puffs is significantly reduced. Also, the extinguishing cup 14 ensures that the cigarette is properly extinguished and supported when not being smoked.

Due to the simple design of the casing 12 and the extinguishing cup 14, both elements may be manufactured at low cost by stamping, injection molding or other simple manufacturing techniques. The device may be made from a variety of materials including plastic and metal. For instance, the extinguishing cup 14 may be made from aluminum and the casing 12 from a non-flammable plastic.

It is to be understood that what has been described are preferred embodiments of the invention. The invention nonetheless is susceptible to certain changes and alternative embodiments fully comprehended by the spirit of the invention as described above, and a scope of the claim set out below.

I claim:

1. A portable extinguishing device comprising:

a casing;

means for extinguishing a cylindrical smoking material, said extinguishing means being connected to and located within said casing; and a pair of opposing jaws extending from said casing, said jaws being resiliently biased toward each other for releasably gripping a lighter.

2. A device as claimed in claim 1, wherein said casing includes a base having a flat bottom for standing said device on a level surface.

3. A device as claimed in claim 2, wherein said base is orthogonal to said jaws for supporting one end of a lighter.

4. An device as claimed in claim 1, wherein said extinguishing means comprises a generally cylindrical chamber for receiving a portion of said smoking material, and wherein said jaws are adapted to extend along opposing sides of said chamber generally parallel to its central axis.

5. An device as claimed in claim 1, wherein said extinguishing means comprises a generally cylindrical chamber for receiving a portion of said smoking material; and wherein said jaws extend along opposing sides of said chamber generally normal to its central axis.

6. An device as claimed in claims 4 or 5, wherein said chamber has a length that is selected to facilitate said smoking material being supported by a wall of said chamber.

7. A device as claimed in claims 4 or 5, wherein said chamber includes an open end for receiving said smoking material and a flange extending about the perimeter of the open end for guiding the smoking material into the chamber.

8. A device as claimed in claim 1, wherein said casing and said jaws are integrally connected.

9. A device as claimed in claim 1, wherein said extinguishing means is removably connected to said casing.

10. A device as claimed in claim 1, further comprising a clip connected to said casing for attaching said device to an item of clothing.

11. A device as claimed in claim 1, wherein said jaws converge toward each other.

* * * * *